US006811045B1

(12) United States Patent
Masker et al.

(10) Patent No.: US 6,811,045 B1
(45) Date of Patent: Nov. 2, 2004

(54) SPILLPROOF REFRIGERATOR SHELF

(75) Inventors: David Wayne Masker, Louisville, KY (US); Richard Anthony Stich, Saluda, NC (US); Milton Edward Rickert, Westport, KY (US); Richard Alan Dillingham, Louisville, KY (US); Ellen Buell Throdahl, Clearwater, FL (US); Lisa Carol Steelsmith, Louisville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/480,345

(22) Filed: Jan. 10, 2000

(51) Int. Cl.[7] ..... A47F 5/08
(52) U.S. Cl. ..... 211/153; 312/408
(58) Field of Search ..... 211/153; 312/404, 312/408

(56) References Cited

U.S. PATENT DOCUMENTS 4,934,541 A * 6/1990 Bussan et al. ..... 211/153
5,429,433 A * 7/1995 Bird et al. ..... 211/187
5,441,338 A * 8/1995 Kane et al. ..... 312/408
5,641,217 A * 6/1997 Caruso et al. ..... 312/404
5,677,030 A * 10/1997 Shanok et al. ..... 108/27

* cited by examiner

*Primary Examiner*—Peter M. Cuomo
*Assistant Examiner*—Erica B. Harris
(74) *Attorney, Agent, or Firm*—H. Neil Houser, esq.; Armstrong Teasdale, LLP

(57) ABSTRACT

A shelf for a refrigerator includes a plate, a cross support, a side support, and a frame. The plate includes first and second surfaces. The frame is adhered to a first surface of the plate and forms a sealed spill containment area. The second surface of the plate adhered to a cross support or side support for an easily manufactured and assembled spillproof shelf.

13 Claims, 7 Drawing Sheets

SPILLPROOF REFRIGERATOR SHELF

BACKGROUND OF THE INVENTION

This invention relates generally to shelves and, more particularly, to refrigerator shelves.

A refrigerator typically includes a number of shelves for the storage of food and beverage containers of many shapes and sizes. As the containers are retrieved, returned and/or rearranged on the shelves, occasional leaks and spilling of food and liquid may occur. Cleaning up after a spill on a crowded refrigerator shelf can be difficult, especially when spilled liquid leaks onto lower shelves.

To contain liquid spills on a refrigerator shelf, it is known to use "picture frame" shelves. See, for example U.S. Pat. No. 5,677,030. Picture frame shelves include edges that are wrapped around, attached, or otherwise fitted to a glass plate to form a dam around the edges of the plate for containing spilled liquid.

The seal of the picture frame, however, is dependent on the external dimensions of the glass plate which vary somewhat from plate to plate. In addition, insert molding, or glass encapsulation processes, used to manufacture picture frame shelves may depend on shrinkage of the plastic used to fabricate the frame. Because of the plastic shrinkage, the edges of the glass plate must be notched and edged for the frame to properly seal the glass. Further, picture frame shelves are typically supported only on the edges of the plate and therefore require a glass plate having a thickness sufficient to support the entire load of the shelf.

Accordingly, it would be desirable to provide a refrigerator shelf that contains spills that is not as dependent on the external dimensions of the glass plate as a picture frame shelf. In addition, it would be desirable if the shelf seal does not depend on shrinkage of the fabrication material. Further, it would desirable if the shelf could be manufactured inexpensively and assembled easily.

BRIEF SUMMARY OF THE INVENTION

In an exemplary embodiment of the invention, a refrigerator shelf includes a substantially flat plate, a cross support and a frame. The frame is sealed to a substantially flat surface of the glass to contain spilled liquids.

The plate includes a substantially flat first surface and a substantially flat second surface. The cross support extends beneath the plate first surface and between a pair of shelf side supports. The cross support transfers a load of the shelf to the side supports.

The shelf frame is sealed to the second surface of the plate with an adhesive around the edges of the second surface. Consequently, the frame seal is independent of the size of the glass plate and independent of shrinkage of the material used to make the frame. Rather, the sealing of the frame depends on the flatness of the glass, which is easier to control than plate dimensions and plastic shrinkage.

DETAILED DESCRIPTION OF THE INVENTION

Figure 1:
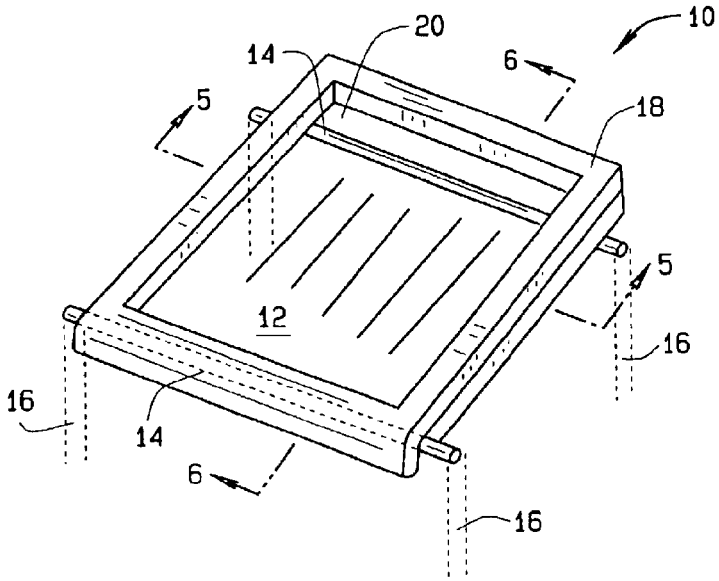
FIG. 1 is a perspective view of a first exemplary embodiment of a refrigerator shelf including a frame.

FIG. 1 illustrates a perspective view of a refrigerator shelf 10 including a plate 12, a plurality of cross supports 14, a plurality of side supports 16 and a frame 18. Frame 18 forms a sealed containment area 20 on plate 12 to contain spilled liquids. Plate 12 is substantially flat, is fabricated from glass, plastic or other material, and is capable of supporting items placed thereon. In addition, plate 12 is substantially rectangular in shape and includes four side edges (not shown in FIG. 1).

Figure 2:
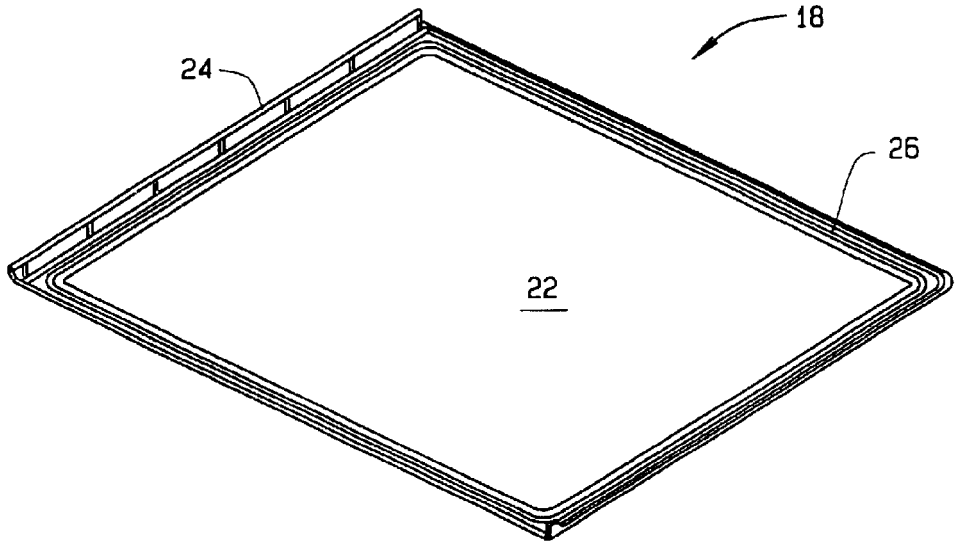
FIG. 2 is a perspective view of the frame shown in FIG. 1.

FIG. 2 illustrates a perspective view of the underside of frame 18. Frame 18 is a one piece, substantially rectangular frame fabricated from molded plastic, and forms a center opening 22 that, together with plate 12 (FIG. 1), forms containment area 20 (FIG. 1). A curved lip 24 at the front of frame 18 prevents scrapes and snags with a front edge (not shown) of plate 12 during use of shelf 10 inside the refrigerator. Shelf 10 also includes an underside channel 26 that allows frame 18 to be adhered to plate 12 (FIG. 1).

Frame 18 is fabricated from inexpensive, integrally molded plastic. In alternative embodiments, frame 18 is fabricated from other materials, including, but not limited to, talc filled polypropylene, acrylonitrile-butadiene-styrene (ABS), or High Impact Polystyrene (HIPS). In a further alternative embodiment, the frame is assembled from a plurality of frame segments having underside channels that form a substantially continuous underside channel around an outer periphery of the plate when the segments are assembled.

Figure 3:
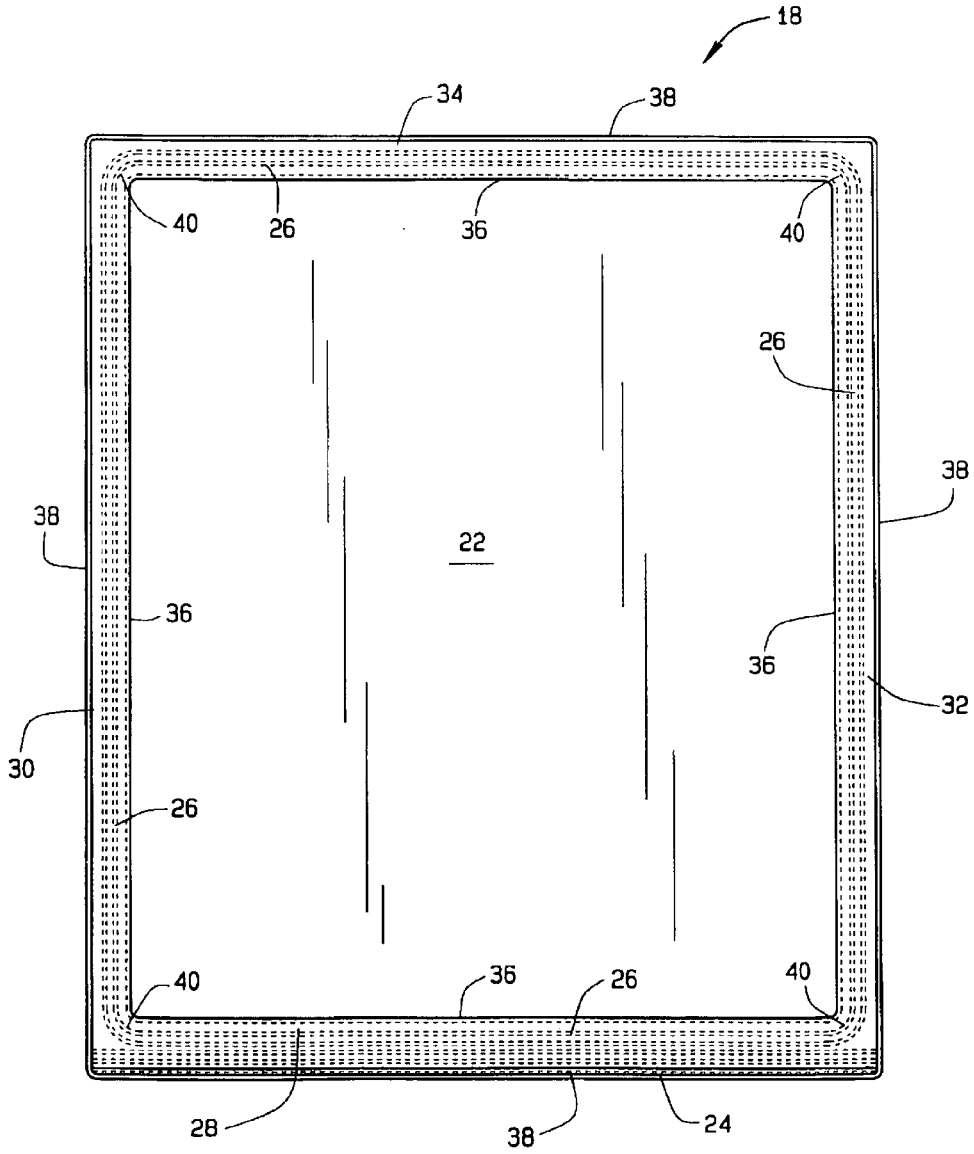
FIG. 3 is a top plan view of the frame shown in FIG. 2.

FIG. 3 is a top plan view of frame 18 including a front side 28, a left side 30, a right side 32, and a rear side 34. Each side includes an inner edge 36 partially defining center opening 22, and an outer edge 38 partially defining an exterior of frame 18. Frame 18 has a uniform dimension between inner edge 36 and outer edge 38 on left side 30, rear side 34, and right side 32, and an increased dimension between inner edge 36 and outer edge 38 on a front side 28 by virtue of front lip 24. Underside channel 26 extends continuously around frame 18 between inner edges 36 and outer edges 38 of sides 28, 30, 32, 34, and includes rounded corners 40 that increase the structural integrity of shelf 10 (FIG. 1) by reducing stress on the corners of plate 12 (FIG. 1) when frame 18 is adhered to plate 12.

Figure 4:
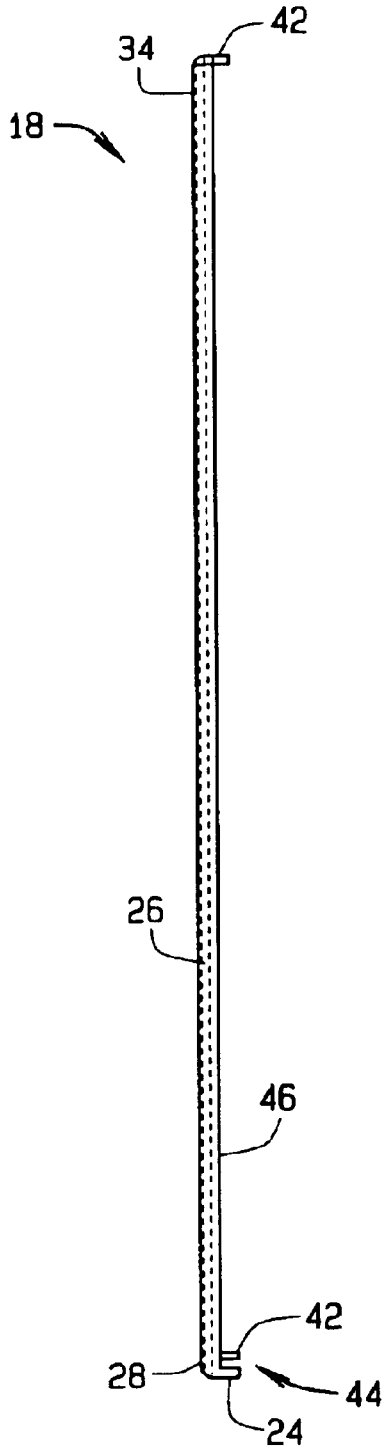
FIG. 4 is a side elevational view of the frame shown in FIG. 3.

FIG. 4 is a side elevational view of frame 18 including positioning ribs 42 adjacent front side 28 and rear side 34 of frame 18. Front positioning rib 42 is spaced from front lip 24 forming a gap 44 to insulate plate 12 (FIG. 1) from frontal impact. Therefore, frame 18 will absorb frontal impact and prevent direct impact with the front edge (not shown) of plate 12 (shown in FIG. 1). In addition a side extension 46 extends below underside channel 26 to facilitate positioning of frame 18 in relation to plate 12 (FIG. 1).

Figure 5:
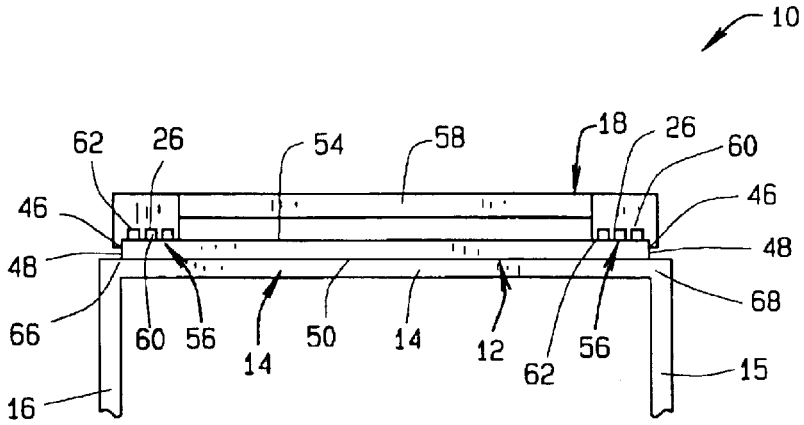
FIG. 5 is a cross-sectional view of the refrigerator shelf shown in FIG. 1 along line 5—5.

FIG. 5 is a longitudinal cross sectional view of shelf 10 illustrating the attachment of frame 18 to plate 12. A first surface 50 of plate 12 is adhered to a cross support 14 and a second surface 54 of plate 12 is adhered to frame 18 along an outer periphery 56, which is generally defined by a portion of second plate surface 54 adjacent plate edges 48. Frame side extensions 46 are positioned adjacent plate side edges 48, and a barrier portion 58 of frame 18 substantially covers plate outer periphery 56 and forms a generally impermeable containment area 20 (FIG. 1) after frame 18 is adhered to plate 12.

Underside channel 26 extends underneath barrier portion 58 along the entire plate outer periphery 56. A sealing adhesive 60 occupies underside channel 26 and frame 18 is adhered to plate second surface 54. Overflow channels 62 on either side of underside channel 26 contain overflow of sealing adhesive 60, or, alternatively are also filled with sealing adhesive 60 to form a triple seal frame. Sealing adhesive 60 is one of several suitable adhesives known in the art, including, but not limited to, RTV (room temperature vulcanization) silicones with adequate adhesion and non-corrosive properties. Thus, a seal extends around containment area 20 (FIG. 1) and contains spilled liquid within barrier portion 58.

A pair of cross supports 14 are attached to plate first surface 50 with a suitable adhesive well known in the art, including, but not limited to, double sided tape, RTV and tape combinations, and fast or triggered curing liquid adhesive. Each cross support 14 is fabricated from steel, is substantially cylindrical, and includes a first end 66 and a second end 68.

A pair of steel side supports 16 extend substantially perpendicular to plate 12. Side supports 16 are fabricated to support a preselected load on shelf 10 and are attached to inside walls (not shown) of a refrigerator (not shown). While the illustrated side supports 16 are upright, i.e., substantially vertically oriented, supports, in an alternative embodiment side supports 16 are substantially horizontally oriented cantilever beam elements attached to an inside wall of the refrigerator. In a further alternative embodiment, the side supports are freestanding inside the refrigerator. In yet another embodiment, the side supports are integrally molded into or attached to the walls of the refrigerator.

First end 66 and second end 68 of each cross support 14 are connected substantially perpendicularly to side supports 16 and support plate 12 as beam elements between side supports 16. Cross supports 14 are positioned substantially level within the refrigerator so that food and beverage containers may be stored on plate 12 without tipping and spilling. In an alternative embodiment, one, three or more cross supports 14 support plate 12.

Figure 6:
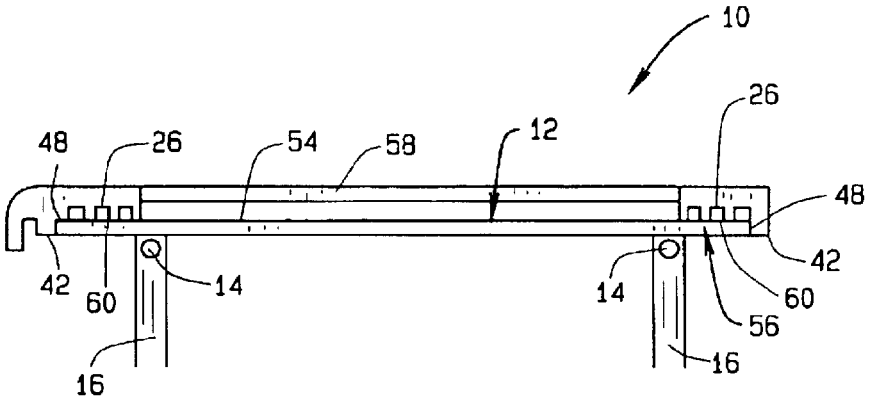
FIG. 6 is a cross-sectional view of the refrigerator shelf shown in FIG. 1 along line 6—6.

FIG. 6 illustrates a lateral cross section of shelf 10. Plate 12 is positioned between front and rear positioning ribs 42. Cross supports 14 are connected to side supports 16 and extend substantially parallel to plate side edges 48. Frame underside channel 26 extends substantially parallel to plate side edges 48. Sealing adhesive 60 in underside channel 26 forms a continuous seal between barrier portion 58 and plate second surface 54 along plate outer periphery 56.

A method for assembling shelf 10 includes filling frame underside channel 26 with a sealing adhesive 60 and adhering frame 18 to second surface 54 of plate 12 along outer periphery 56. Adhesive may be applied to cross supports 14 and/or plate first surface 50, and cross supports 14 adhered to plate first surface 50. Each cross support 14 is then attached to side supports 16 at first end 66 and second end 68 (FIG. 5) so that plate 12 is substantially level.

Shelf 10 therefore provides an easily assembled spillproof shelf. Adhesively sealed frame 18 cooperates with glass plate 12 to contain a spill within containment area 20. The seal of the frame is primarily dependent upon the flatness of plate 12, rather than the external dimensions of plate 12 and shrinkage of material used to fabricate frame 18. The flatness of plate 12 is easier to consistently control as compared to external dimensions of plate 12. Finally, adhesively attached cross supports 14 transfer a shelf load from plate 12 to side supports 16 and therefore reduce the structural requirements of plate 12. Hence, plate 12 need not be dimensioned to support the entire load itself, and savings may be realized in a thinner plate 12. For all the above reasons, shelf 10 may be fabricated and assembled relatively quickly and inexpensively in comparison to known picture frame shelves.

Figure 7:
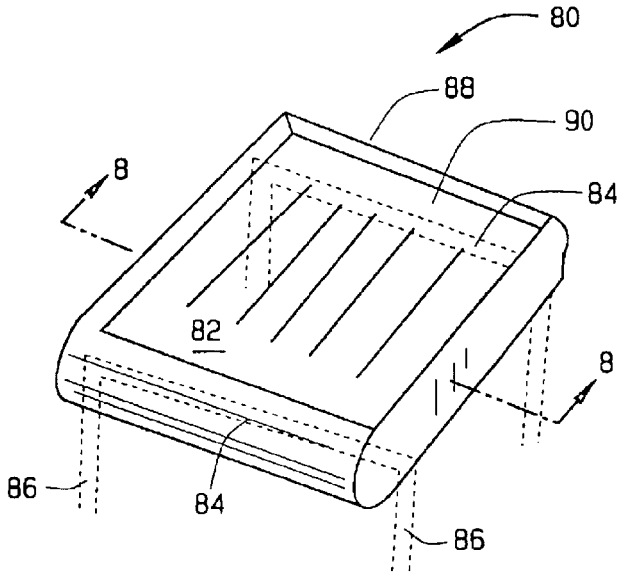
FIG. 7 is a perspective view of a second embodiment of a refrigerator shelf.

A second exemplary embodiment of a refrigerator shelf 80 is shown in FIG. 7 and includes a plate 82, cross supports 84, side supports 86, and a frame 88. Frame 88 forms a sealed containment area 90 on plate 82 to contain spilled liquids.

Figure 8:
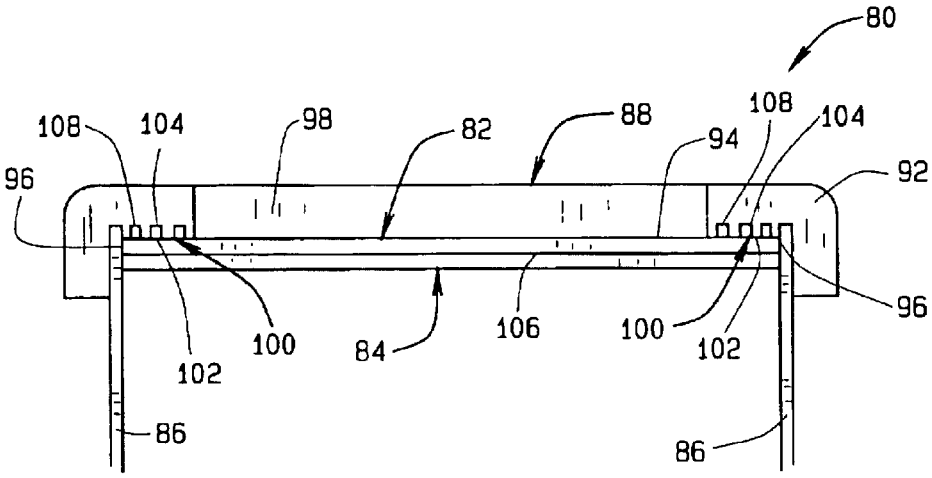
FIG. 8 is a cross-sectional view of the refrigerator shelf shown in FIG. 7 along line 8—8.

FIG. 8 is a cross sectional view of shelf 80 including frame 88 that includes an L-shaped bracket portion 92 adhered to a second plate surface 94. Plate 82 includes side edges 96 and L-shaped bracket portion 92 extends around plate edges 96, and snap fits to side supports 86. In an alternative embodiment, the bracket portion is connected to the side supports according to other known attachment methods. Bracket portion 92 retains plate 82 between a barrier portion 98 of frame 88 and side supports 86 and cross supports 84. Barrier portion 98 is sealed to plate outer periphery 100 with a sealing adhesive 102 in underside channel 104, and cross supports 84 are adhered to plate first surface 106. Spillover adhesive is contained in overflow channels 108 on either side of underside channel 104.

A method for assembling shelf 80 includes filling underside channel 104 of frame with sealing adhesive 102 and adhering frame 88 to plate second surface 94 along outer periphery 100. Adhesive may be applied to cross supports 84 and/or plate first surface 106, and cross supports 84 are then adhered to plate first surface 106. Each cross support 84 is then attached to side supports 86 so that plate 82 is substantially level. Bracket portion 92 is then attached to side supports 86.

Figure 9:
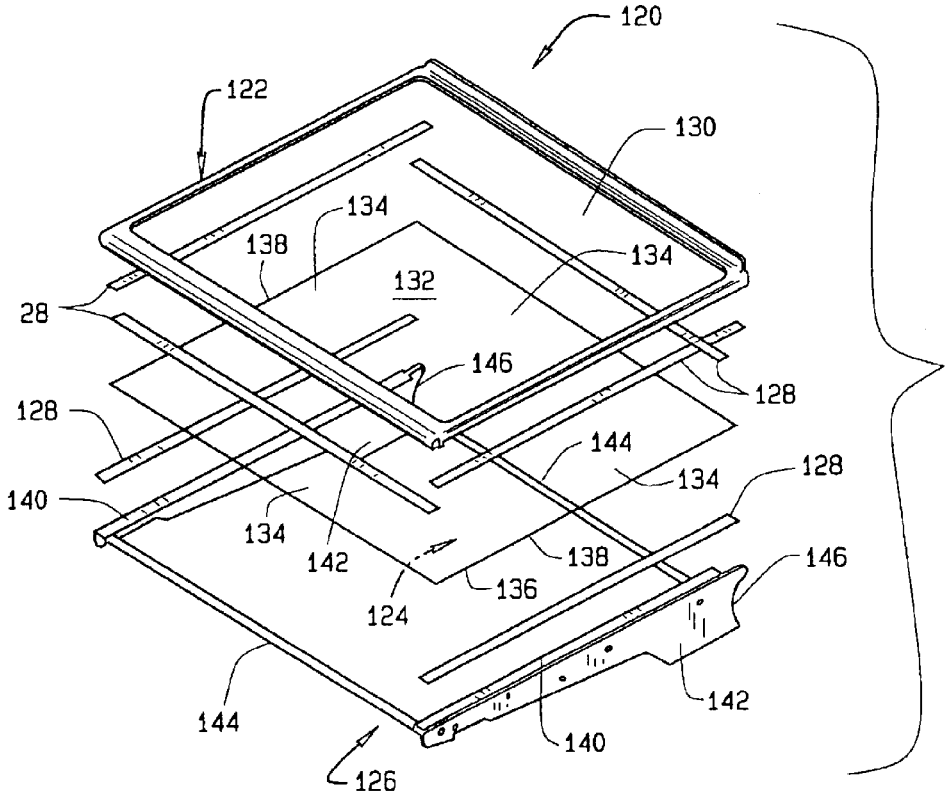
FIG. 9 is an exploded view of a third embodiment of a refrigerator shelf.

A third exemplary embodiment of a refrigerator shelf 120 is shown in FIG. 9 and includes a frame 122, a plate 124, a shelf support 126, and a plurality of strips of a solid double sided adhesive 128 for adhering frame 122 to plate 124 and plate 124 to shelf support 126. Using a solid double sided adhesive 128, such as double sided tape, shelf 120 can be assembled relatively quickly and easily in comparison to known shelf constructions.

In a particular embodiment, double sided adhesive 128, is double sided tape fabricated from 1/16 inch thick closed cell polyethylene foam with rubber adhesive on opposite sides of the foam. The closed cell polyethylene foam prevents fluid passage through the tape, and allows relative movement between plate 124 and frame 122 due to different coefficients of thermal expansion of the respective materials in the cold environment of a refrigerator. In alternative embodiments, double sided tape is fabricated from urethane, acrylic, or neoprene with an adhesive on opposite sides. In a further alternative embodiment, double sided adhesive is a thermoplastic film that becomes adhesive when heated.

Frame 122 is fabricated from inexpensive, integrally molded plastic. In alternative embodiments, frame 122 is fabricated from other materials, including, but not limited to, talc filled polypropylene, acrylonitrile-butadiene-styrene (ABS), or High Impact Polystyrene (HIPS). In a further alternative embodiment, frame 122 is assembled from a plurality of frame segments that form a spill containment area 130 around the edges of plate 124. Frame 122 is secured to a second surface 132 of plate 124 along each side of a plate outer periphery 134 using strips of double sided adhesive 128. Additionally, a sealing adhesive (not shown), such as RTV silicon, is used at each corner of plate 124 where double sided adhesive strips 128 intersect to ensure that plate outer periphery 134 is sealed to form a spill containment area 130.

A first surface 136 of plate 124 is secured to shelf support 126 using a strip of double sided adhesive 128 along the lateral edges of plate 124. Plate first surface 136 lateral edges 138 rest upon and are adhered to flat shoulders 140 of shelf side supports 142. Side supports 142 are connected to one another by cross supports 144 and are configured at a proximal end 146 for attachment to a refrigerator wall (not shown) so that shelf 120 extends from the refrigerator wall as a cantilever beam. In an alternative embodiment, shelf side supports 142 are configured for lateral engagement with a refrigerator wall, such as, for example, by fitting side supports into grooves or indentations formed in a refrigerator liner.

Figure 10:
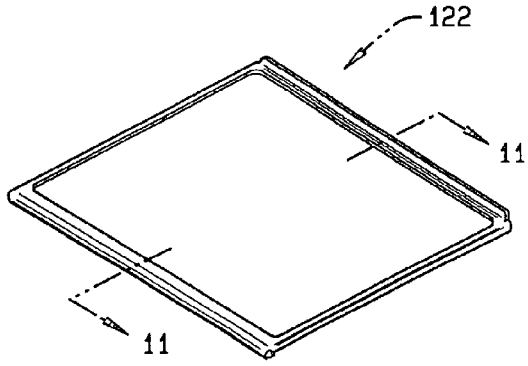
FIG. 10 is a perspective view of the shelf frame shown in FIG. 1.
Figure 11:
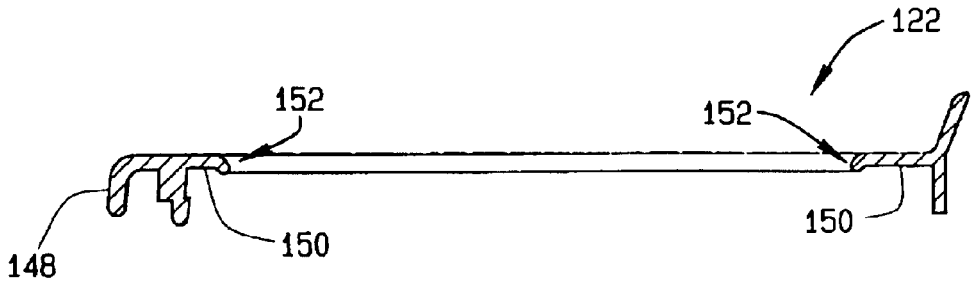
FIG. 11 is a cross sectional view of the shelf frame shown in FIG. 10 taken along line 11—11.

FIG. 10 is a perspective view of frame 122 and FIG. 11 is a cross sectional view of frame 122 from front to back. A curved lip 148 at the front of frame 122 prevents scrapes and snags with a front edge (not shown) of plate 124 (FIG. 9) during use of shelf 120 inside a refrigerator. An underside 150 of frame 122 is substantially flat to facilitate a strong bond with double sided adhesive 128 (FIG. 9), and deformable sealing lips 152 form a seal with plate 124 (FIG. 9) to contain spills on shelf 120 (FIG. 9). In an alternative embodiment, underside 150 of frame 122 includes channels or grooves (not shown), such as those described above with reference to FIGS. 2 and 3.

Figure 12:
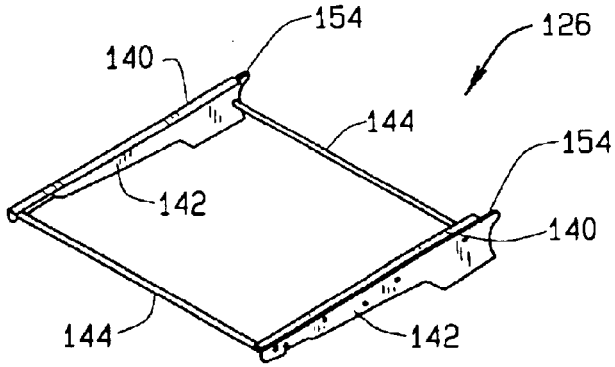
FIG. 12 is a perspective view of the shelf support system shown in FIG. 9.

FIG. 12 is a perspective view of shelf support 126 including two side supports 142 and two cross supports 144 fabricated from steel or other materials known in the art for supporting a predetermined shelf load. Flat shoulders 140 extend along a top edge 154 of each side support 142 to facilitate bonding of each side support 142 to shelf plate 124 (FIG. 9). Cross supports 144 extend below side plate shoulders 140 so that cross supports 144 are separated from shelf plate 124.

A method of assembling shelf 120 includes placing double sided adhesive strips 128 around the edges of plate 124 and placing a small amount of liquid adhesive at each corner of plate 124. Frame 122 and plate 124 are pressed together to form an adhesive bond, and frame sealing lips 152 create a sealed spill containment area 130 on plate second surface 132. Double sided adhesive strips are then adhered to one of plate lateral edges 138 and side support shoulders 140 of shelf support 126. Shelf support 126 and plate 124 with adhered frame 122 are pressed together to form an adhesive bond between plate 124 and shelf support 126.

Thus, shelf 120 may be manufactured relatively simply and quickly relative to known refrigerator shelf constructions. As frame 122 is adhered to the flat surface of plate 124, complicated insert molding and glass encapsulation processes are avoided.

While the invention has been described in terms of various specific embodiments, those skilled in the art will recognize that the invention can be practiced with modification within the spirit and scope of the claims.

What is claimed is:

1. A shelf for a refrigerator, said shelf comprising:

a substantially flat plate including a first surface, a second surface different from said first surface, and an outer periphery;

at least one cross support extending below and joined to said plate first surface by a solid adhesive;

a frame separate from said at least one cross support, said frame adhered to said outer periphery of said plate second surface and forming a seal; and at least one side support connected to said cross support and configured for attachment to a refrigerator, said frame adhered to one of said cross support and said side support.

2. A shelf in accordance with claim 1 wherein said frame is adhered to said second surface with a solid adhesive.

3. A shelf in accordance with claim 1 wherein said frame comprises a channel, said seal positioned at least partially within said channel.

4. A shelf in accordance with claim 3 wherein said frame further comprises a bracket connected to said cross support.

5. A shelf in accordance with claim 1 wherein said frame comprises molded plastic.

6. A shelf in accordance with claim 1 wherein said seal comprises an adhesive seal.

7. A shelf for a refrigerator, said shelf comprising:

a plate including a first surface, a second surface different from said first surface, and an outer periphery;

first and second side supports supporting said plate first surface;

at least one cross support connecting said first and second side supports, wherein said at least one cross support is adhered to said first surface of said plate with an adhesive; and a frame separate from said at least one cross support and adhered to said second surface of said plate by an adhesive, said frame extending along said plate outer periphery to form a spill containment area.

8. A shelf in accordance with claim 7 wherein said frame comprises a sealing lip.

9. A shelf in accordance with claim 8 wherein said frame further includes a bracket, said bracket connected to said side support.

10. A shelf in accordance with claim 7 wherein said frame comprises at least one underside channel.

11. A shelf in accordance with claim 10 wherein said shelf further comprises a sealing adhesive contained in said underside channel.

12. A shelf in accordance with claim 7 wherein said frame and said side supports are adhered to said plate with a solid adhesive.

13. A shelf for a refrigerator, said shelf comprising:

a substantially flat plate including first and second surfaces and an outer periphery;

at least one steel cross support extending below said plate first surface;

a frame adhered to said outer periphery of said plate second surface and forming a seal;

at least one side support connected to said cross support and configured for attachment to a refrigerator, said frame adhered to one of said cross support and said side support; and an adhesive adhering said at least one cross support to said plate first surface.

* * * * *